US006739706B2

(12) United States Patent
Barinaga et al.

(10) Patent No.: US 6,739,706 B2
(45) Date of Patent: May 25, 2004

(54) OFF AXIS INKJET PRINTING SYSTEM AND METHOD

(75) Inventors: Louis C. Barinaga, Salem, OR (US); Ashley E. Childs, Corvallis, OR (US); Daniel D. Dowell, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 128 days.

(21) Appl. No.: 10/126,160

(22) Filed: Apr. 19, 2002

(65) Prior Publication Data

US 2003/0197766 A1 Oct. 23, 2003

(51) Int. Cl.[7] ..... B41J 2/175; B41J 2/18
(52) U.S. Cl. ..... 347/85; 347/89
(58) Field of Search ..... 347/84, 85, 86, 347/87, 89, 92–93, 7

(56) References Cited

U.S. PATENT DOCUMENTS 5,751,300 A 5/1998 Cowger et al. ..... 347/6
5,847,736 A 12/1998 Kanbayashi et al. ..... 347/89
5,936,560 A 8/1999 Hall et al.
5,936,650 A 8/1999 Ouchida et al. ..... 347/89
6,099,112 A 8/2000 Olazabal
6,547,377 B2 * 4/2003 Thielman et al. ..... 347/85
6,550,898 B2 * 4/2003 Hayashi et al. ..... 347/85
6,598,963 B1 * 7/2003 Yamamoto et al. ..... 347/85

FOREIGN PATENT DOCUMENTS

EP 0965452 A1 12/1999
EP 0967083 A2 12/1999

* cited by examiner

*Primary Examiner*—Lamson Nguyen
*Assistant Examiner*—K. Feggins

(57) ABSTRACT

A fluid delivery system and method, which employs a print head assembly (PHA) and an fluid supply for intermittent connection. A pump structure re-circulates fluid through the re-circulation path during a pump mode. The fluid supply includes a supply reservoir for holding a supply of fluid, and is connectable to the PHA to provide a fluid interconnect between the supply reservoir and the PHA fluid reservoir when a pressure differential between the PHA and the supply reservoir is sufficient to draw fluid into the PHA free fluid reservoir to replenish the fluid in the PHA fluid reservoir.

32 Claims, 5 Drawing Sheets

OFF AXIS INKJET PRINTING SYSTEM AND METHOD

BACKGROUND OF THE DISCLOSURE

Inkjet printing systems are in common use today. In one common form for swath printing, the printing systems includes one or more print cartridges mounted on a scanning carriage for movement along a swath axis over a print medium at a print zone. The print medium is incrementally advanced through the print zone during a print job.

There are various print cartridge configurations. One configuration is that of a disposable print cartridge, typically including a self-contained ink or fluid reservoir and a printhead. Once the fluid reservoir is depleted, the print cartridge is replaced with a fresh cartridge. Another configuration is that of a permanent or semi-permanent print cartridge, wherein an internal fluid reservoir is intermittently or continuously refilled with fluid supplied from an auxiliary fluid supply. The auxiliary supply can be mounted on the carriage with the print cartridge, or mounted off the carriage in what is commonly referred to as an "off-axis" or "off-carriage" system.

Off-axis systems can also take different forms. One form of off-axis fluid delivery system employs flexible tubing to continuously connect between the fluid supply located off-axis and the print cartridge or print head located on the carriage, i.e. on-axis. Another form of off-axis fluid delivery system provides an intermittent connection between the off-axis fluid supply and the carriage-mounted print cartridge, e.g. by moving the carriage to a supply station, where the connection is made.

Typically, each of the existing off-axis forms optimizes particular parameters, such as cost, size, complexity, delivered ink (usage scalability), packing density, air management, number of inks, printhead life, and user intervention rate. As the inkjet market matures, customer expectations become more demanding, and there thus exists the need for ink delivery systems that incorporate substantial improvements in many of these areas simultaneously.

SUMMARY OF THE DISCLOSURE

A fluid delivery system is described, which includes a print head assembly (PHA) and a fluid supply for intermittent connection to the PHA. In an exemplary embodiment, the PHA includes a PHA body structure, an air-fluid separator structure, a printhead, a fluid plenum in fluid communication with the printhead and the air-fluid separator structure, and a PHA free fluid reservoir. A fluid re-circulation path passes through the separator structure, the plenum and the free fluid reservoir. A pump structure is supported by the PHA body structure for re-circulating fluid through the re-circulation path during a pump mode. The fluid supply includes a supply reservoir for holding a supply of fluid, and is connectable to the PHA to provide a fluid interconnect between the supply reservoir and the PHA fluid reservoir when a pressure differential between the PHA and the supply reservoir is sufficient to draw fluid into the PHA free fluid reservoir to replenish the fluid in the PHA fluid reservoir.

In another embodiment, a method is described for supplying fluid to a print head assembly (PHA) including a PHA housing structure, a capillary structure for holding a supply of fluid under negative pressure, a free fluid chamber, a printhead and a fluid plenum in fluid communication between the capillary structure and the printhead. The method includes:

mounting the PHA on a movable carriage of a printing system;

positioning an fluid supply at a supply location off the carriage including a supply reservoir holding a supply quantity of free fluid;

bringing the print cartridge and fluid supply into mating contact so that a PHA fluid interconnect is engaged with a supply fluid interconnect to provide a fluid interconnect path;

pumping fluid through a closed re-circulation path within a PHA housing structure to pump fluid from a PHA free fluid chamber to a PHA capillary structure to a PHA fluid plenum in fluid communication with a PHA printhead and to the free fluid chamber;

and, with the capillary structure in a fluid-depleted state, using a dynamic pressure differential between said fluid plenum and said free fluid chamber to draw fluid from the fluid supply reservoir through the fluid interconnect path until the capillary structure reaches a less depleted state.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE DISCLOSURE

An exemplary embodiment of the invention is an intermittently refillable off axis inkjet printing system, sometimes described as a "take-a-sip" (TAS) fluid delivery system (IDS). This TAS system does not require tubes to supply fluid from an off-carriage fluid supply to the print head. Rather, the system includes an onboard fluid reservoir that provides fluid to the print head during the print cycle. This fluid reservoir is intermittently recharged via a fluid coupling between the print head and the off-carriage supply.

Figure 1:
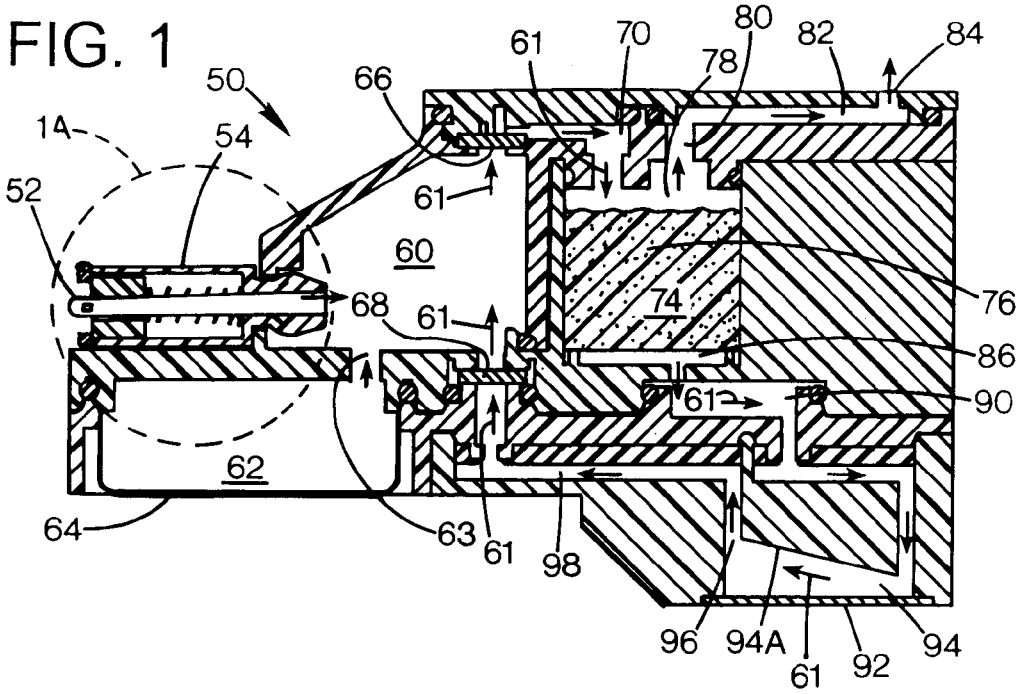
FIG. 1 is a diagrammatic cross sectional diagram of an embodiment of a print head assembly (PHA) unit comprising an exemplary "take-a-sip" fluid delivery system in accordance with aspects of the invention.

A cross sectional diagram of a print head assembly (PHA) 50 comprising an exemplary TAS IDS is shown in FIG. 1. A needle septum fluid interconnect 52 defines the entry point for fluid into the PHA. The needle is insert molded into a rigid plastic part 54 that protrudes into a free fluid chamber 60, the common chamber. Below this chamber, and in direct fluid communication through a small aperture 63, is a diaphragm pump chamber 62 of a diaphragm pump 64.

Figure 1A:
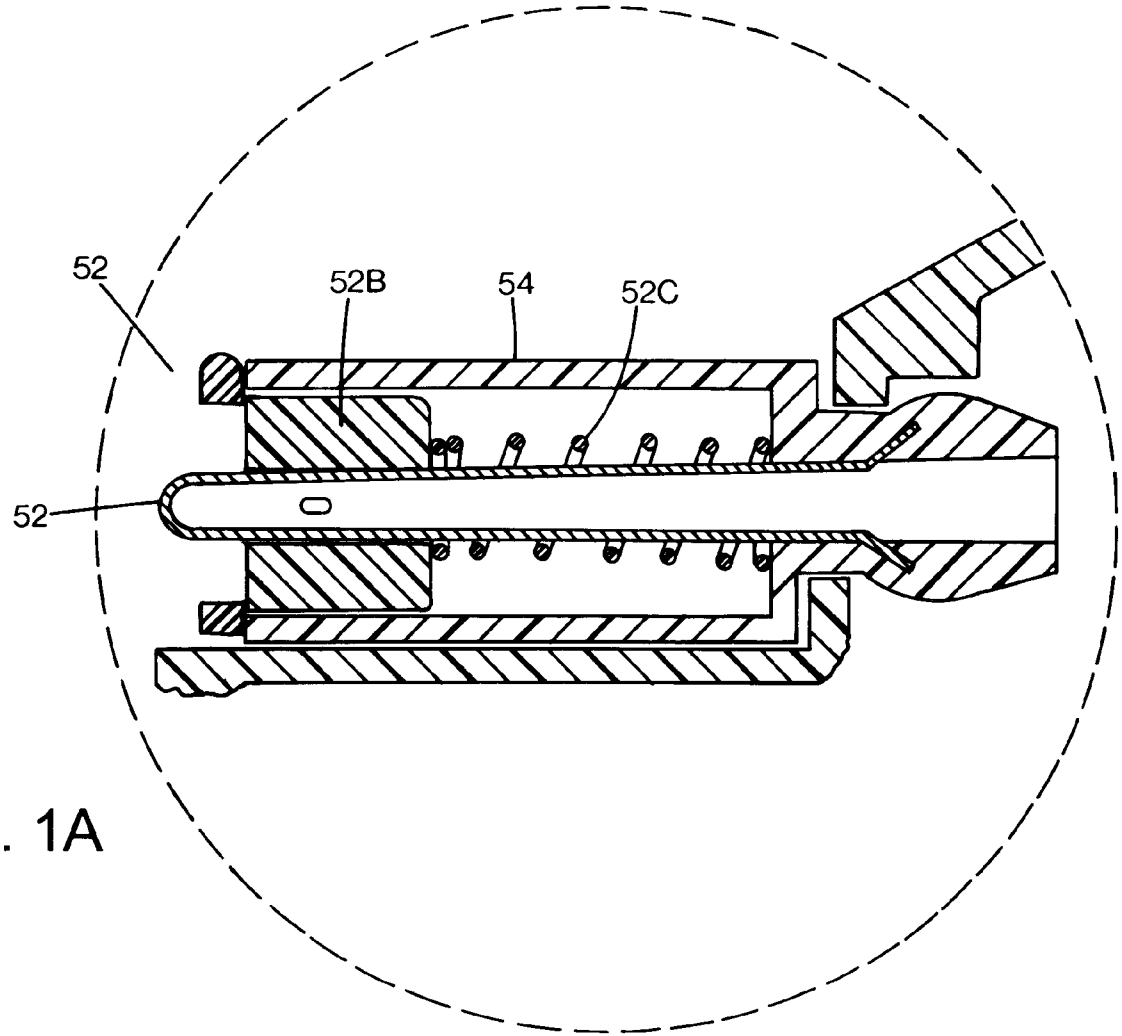
FIG. 1A shows the exemplary embodiment of the interconnect portion in enlarged view, with some features omitted for clarity.

FIG. 1A shows the exemplary embodiment of the interconnect 52 in enlarged view, with some features omitted for clarity. The interconnect includes a hollow needle 52 with an opening near its distal end, through which fluid can pass when connected to a mating interconnect. A sliding seal 52B fits about the distal end of the needle, within the part 54, and is biased to the closed position (shown in FIG. 1A) by a spring 52C. In the closed position, the sliding seal covers and seals the needle opening. In the open position, the seal is slid back into part 54, exposing the needle opening, and allowing fluid to be admitted into the hollow needle.

A one-way inlet valve 66, also called a check valve, is positioned at the top of the common chamber 60. The inlet valve is oriented to allow fluid flow out of the common chamber, and to resist fluid flow into the chamber.

Another check valve 68, the recirculation valve, is positioned directly below the inlet valve on the bottom face of the chamber 60. The recirculation valve is oriented to allow fluid flow into the common chamber 60, and to resist fluid flow out of the chamber.

A horizontal fluid channel 70 above the inlet valve 66 connects the valve to a chamber 74 via an aperture in the top of the chamber. A body of capillary material 76 is disposed in the chamber 74, sometimes called the capillary chamber. The capillary material 76 could be made from various materials including foam or glass beads. A small volume 78 of empty space exists at the top of the capillary material.

A second aperture 80 exists on the top face of the capillary chamber 74. This opening connects the top of the capillary chamber to a small channel 82 that leads to a labyrinth vent 84. This labyrinth vent impedes vapor transmission from the capillary chamber to the outside atmosphere.

At the bottom of the capillary chamber 74, an ultra fine standpipe filter 86 is staked. This filter functions as the primary filtration device for the system.

Below the filter 86, a small fluid inlet channel 90 creates a fluid connection between the bottom of the stand pipe filter and the top surface of the print head 92, which includes a nozzle array, typically defined as a plurality of orifices in an orifice or nozzle plate. This channel 90 connects to the front of the die pocket, forming a fluid plenum 94. The top surface 94A of the PHA body defining the fluid plenum ramps upwardly, to direct air bubbles upwardly. A second aperture 96, referred to as the outlet, is positioned at the back of the plenum 94. A fluid channel 98, the recirculation channel, connects the outlet 96 to the bottom of the recirculation valve 68.

In this exemplary embodiment, the fluid is a liquid ink during normal printing operations. The fluid can alternatively be a cleaning fluid during a maintenance operation, a make-up fluid or the like. The printhead can be any of a variety of types of fluid ejection structures, e.g. a thermal inkjet printhead, or a piezoelectric printhead.

The recirculation channel 98 completes a fluid circuit (represented by arrow 61) that allows fluid to flow from the common chamber 60, the capillary chamber 74, through the fluid plenum 94, and return to the common chamber 60, given proper pressure gradients through the check valves 66, 68.

Figure 2:
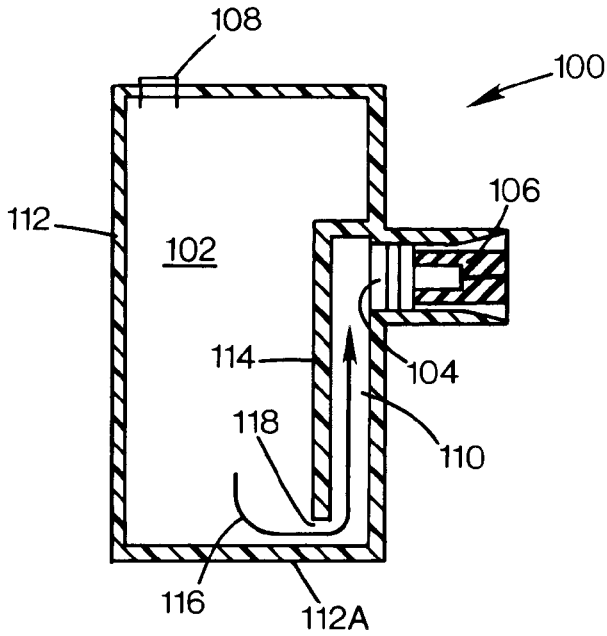
FIG. 2 is a diagrammatic cross-sectional diagram of an embodiment of an exemplary fluid supply which can be connected to the PHA of FIG. 1 for fluid replenishment.

Another part of this embodiment of a TAS system is a free fluid supply 100. As shown in FIG. 2, this embodiment of the supply includes a free fluid chamber 102, check valve 104, fluid interconnect 106, and a vent 108 which is normally closed, and only open during replenishment. At all other times, the vent is closed. This type of vent action is implemented to prevent fluid leakage if the supply is oriented so that the fluid comes into contact with the vent feature. In one embodiment, the vent 10 is an active vent, e.g. a valve actuated by a printer motion to open (such as a valve driven by a gear slaved to an insertion or printer motion, or a valve actuated by a cam or cam surface). Alternatively, a passive vent can be employed, such as a ball bubble valve, or a check valve (driven by a pressure gradient).

The check valve 104 can alternatively be placed in the PHA 50, e.g. in a fluid path at the PHA fluid interconnect as it enters the free fluid chamber 60. In this case, the interconnect 106 of the fluid supply 100 is a type which seals when disconnected from the PHA. Placing the function of the check valve 104 in the PHA can lead to reduced cost, since the fluid supply 100 may be replaced many times over the life of the PHA.

In this embodiment, a snorkel 110 is defined by wall 114 which approaches the bottom wall 112A of the housing 112, leaving an opening 118 through which fluid can flow from chamber 102 along a path indicated by arrow 116 to check valve 104. The snorkel ensures complete or virtually complete depletion of the fluid within the chamber 102.

An event-based description of operation communicates the function of the IDS comprising PHA 50 and supply 100. For clarity, actual pressure values will be omitted and instead reference will be made to high, medium, target, and low back pressure states. The term "back pressure" denotes vacuum pressure, or negative gage pressure.

At the time of manufacture, the PHA 50 is assembled and fluid is injected into the assembly until the diaphragm pump chamber, common chamber, plenum, recirculation channel, and inlet channel are full. Fluid is injected into the capillary material until the proper back pressure for print head operation is reached.

During printing, the IDS behaves similarly to a foam based IDS design as used in conventional disposable cartridges. Ejection of drops out of the nozzles of the print head 92 causes the back pressure to build in the standpipe region, i.e. the region below the filter and the recirculation check valve. The recirculation valve 68 prevents flow from the common chamber 60 into the plenum 94. The back pressure buildup causes fluid to be drawn from the capillary material 76, through the stand pipe filter 86, and into the plenum 94. This fluid transfer depletes the capillary material, causing dynamic negative or back pressure to build in the standpipe region.

Figure 3:
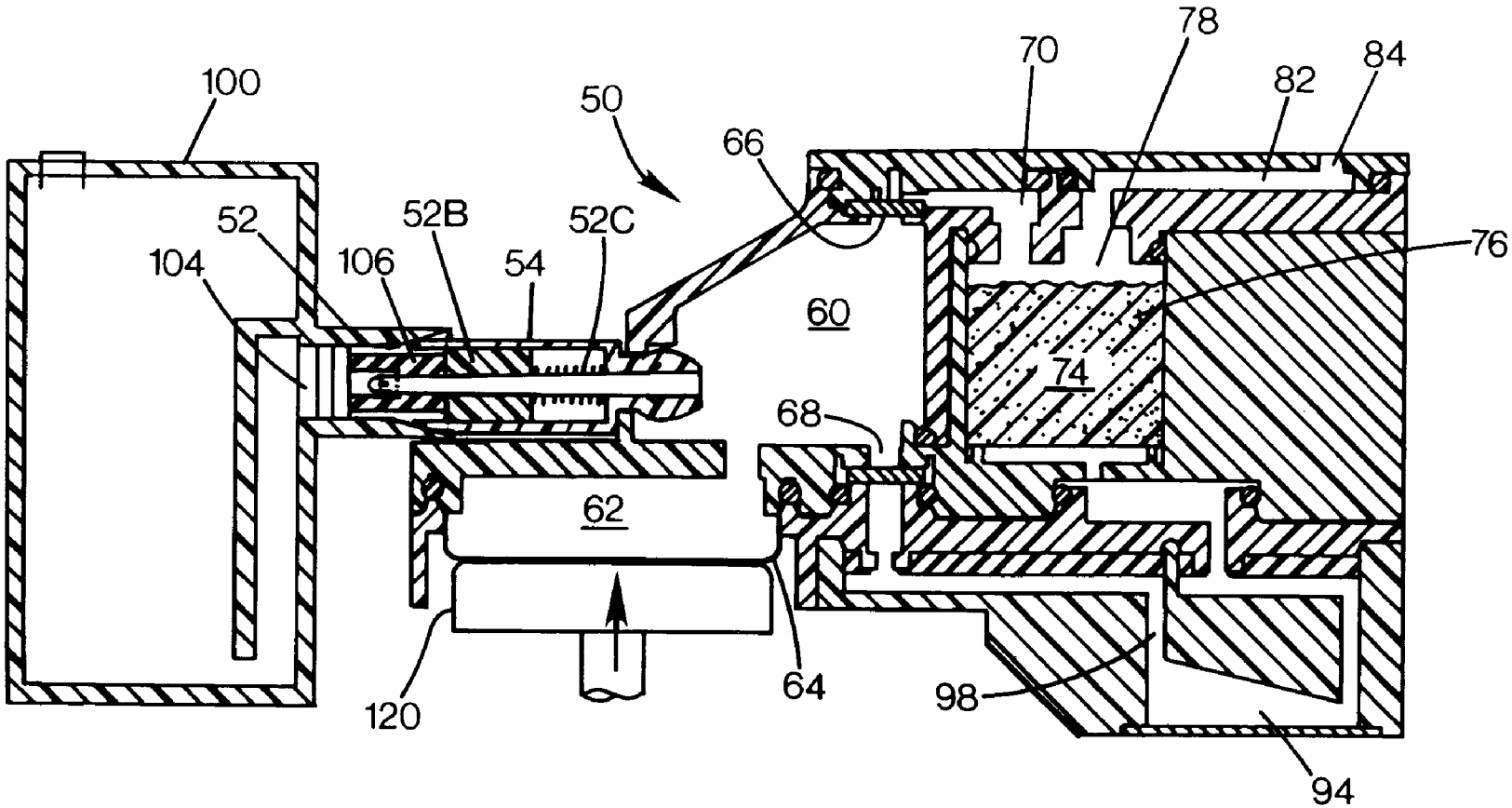
FIG. 3 is a diagrammatic cross-section diagram showing the PHA of FIG. 1 and the fluid supply of FIG. 2 in a connected relationship.
Figure 4:
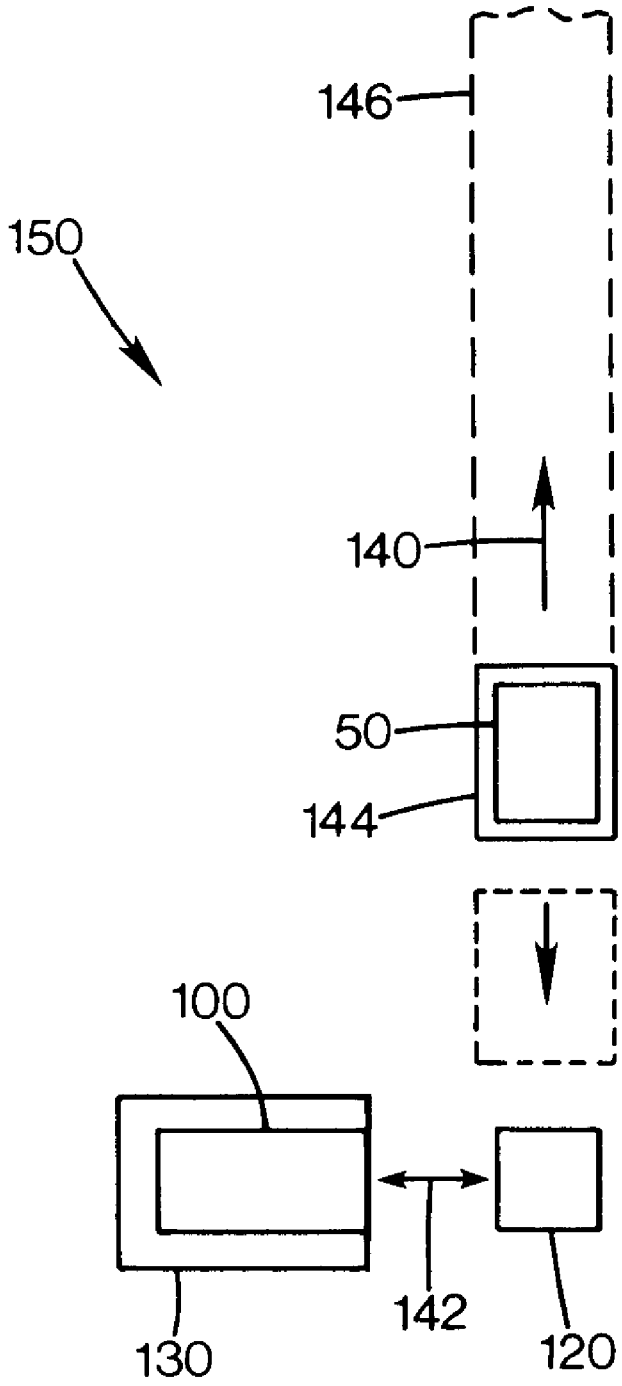
FIG. 4 is a schematic block diagram of an embodiment of a printing system embodying aspects of the invention.

FIG. 4 is a schematic diagram of an inkjet printer 150 embodying aspects of the invention. The PHA unit 50 is mounted in a traversing carriage 144 of the system, which is driven back and forth along a carriage swath axis 140 to print an image on a print medium located at the print zone indicated by phantom outline 146. The fluid supply is mounted on a shuttle 130, in this exemplary embodiment, which is adapted to move the supply 100 along axis 142 from a rest position (as shown in FIG. 4) to a refilling location. After printing, or when required due to a low fluid signal from a printing system drop counter, the PHA 50 is slewed along axis 140 to the designated refilling location in the printer, at which is disposed the pump actuator 120. Then the fluid supply 100 is shuttled toward the PHA 50, causing the fluid interconnects of each component to mate together, as shown in FIG. 3.

The diaphragm pump 64 is then pressed upwardly via a piston comprising the actuator 120, creating a positive gage pressure buildup in the common chamber 60. The pressure builds until the cracking pressure of the inlet valve 66 is reached; consequently, fluid and accumulated air flows through the valve 66 and channel 70, and onto the capillary material 76. The capillary material 76 acts as a fluid/air separator. This function is achieved by the hydrophilic capillary material absorbing the fluid, but not the air. The air is released into the free space 78 above the capillary material. This space is ventilated via the channel 82 and the labyrinth 84, so the air is allowed to escape to the atmosphere. The fluid that absorbs into the depleted capillary material replenishes the fluid volume ire the material, which lowers its back pressure.

Immediately after the pump is pressed, the piston 120 is retracted to allow the pump diaphragm to return to its original shape. This return can be achieved by several techniques. One exemplary technique is to build structure into the shape of the pump, so that the inherently rigidity of the structure will cause it to rebound. Another technique is to use a spring which reacts against the deformation of the piston, returning the pump to its original shape. A diaphragm pump suitable for the purpose is described in co-pending application Ser. No. 10/050,220, filed Jan. 16, 2002, OVER-MOLDED ELASTOMERIC DIAPHRAGM PUMP FOR PRESSURIZATION IN INKJET PRINTING SYSTEMS, Louis Barinaga et al., the entire contents of which are incorporated herein by this reference.

During the return stroke of the pump chamber, the back pressure builds in the common chamber. After a certain magnitude of buildup, the recirculation valve 68 cracks open and allows fluid to flow in to the common chamber 60 from the recirculation channel 98 through the plenum 94. The flow of fluid from the recirculation path is limited due to dynamic pressure losses associated with the capillary material (still in a depleted state), stand pipe filter 86, inlet, outlet, recirculation channel, and recirculation valve. Because of this loss, back pressure continues to build in the common chamber 60 due to further return (expanding) of the pump diaphragm. If the back pressure builds high enough, the supply check valve 104 of the fluid supply will crack open, allowing the fluid flow into the common chamber 60 from the fluid supply 100. A pressure balance results between the recirculation flow and the supply inflow.

After the pump 64 returns to its initial position, the piston again cycles the pump. The same steps as described above result from the second cycle, but there is a key difference between successive cycles. As the cycles continue, the capillary material 76 becomes less depleted due to the influx of fluid into the PHA 50 from the supply 100. This reduction in depletion reduces the amount of dynamic pressure loss associated with the capillary material, and the fluid velocity through the fluid channels comprising the recirculation path increases. With the increased fluid flow through the fluid channels comes an increase in fluid channel loss. However, in this exemplary embodiment, the capillary material is selected so that the capillary pressure loss drops more quickly than the fluid channel loss increases. As a result, the pressure loss associated with the recirculation path is reduced in magnitude. This reduction in pressure loss means that the recirculation path becomes more and more capable of fulfilling all of the flow required by the return stroke of the pump. After the desired amount of fluid has entered the PHA, the recirculation path 61 becomes entirely capable of supplying the required return flow, so that the system ceases to ingest fluid from the supply 100. Thenceforth, subsequent pump cycles will only result in additional recirculation because the system has reached pressure equilibrium. At this point, the system is deemed to be at its "set point".

The IDS has the ability to run a recirculation cycle to function as an air purge from the PHA 50. The recirculation air purge cycle functions almost identically to the refilling procedure, except that the PHA 50 is not coupled to the fluid supply 100. Because this cycle is run with the PHA detached from the supply, the recirculation path 61 of the system is isolated as the only source for flow into the common chamber 60.

The air purge procedure consists of recurring cycles of actuating the pump 64, pumping fluid and air from the common chamber 60 onto the capillary material 76 upon contraction of the pump chamber, and then pulling fluid back through the recirculation path 61 upon subsequent expansion of the pump chamber. Air bubbles will accumulate under the inlet valve 66 due to its positioning at the top of the common chamber 60 and the ramped wall of the PHA. Upon each pump inward stroke, the bubbles are expelled along with the fluid into the capillary chamber 74. From the chamber, the air is vented to the atmosphere via the labyrinth 84.

The TAS system includes features that facilitate small sizing of the IDS assembly, and which allows for a very small, multi-colored IDS. The PHA can be fabricated with a relatively small swept volume, and because the fluid supply is located off-axis, the fluid supply volume is not swept. This leads to reduction in printer volume. Moreover, since the IDS does not use tubes to continuously connect between the PHA and the fluid supply, the swept volume and cost of tubes associated with other off-axis designs is eliminated.

Figure 5:
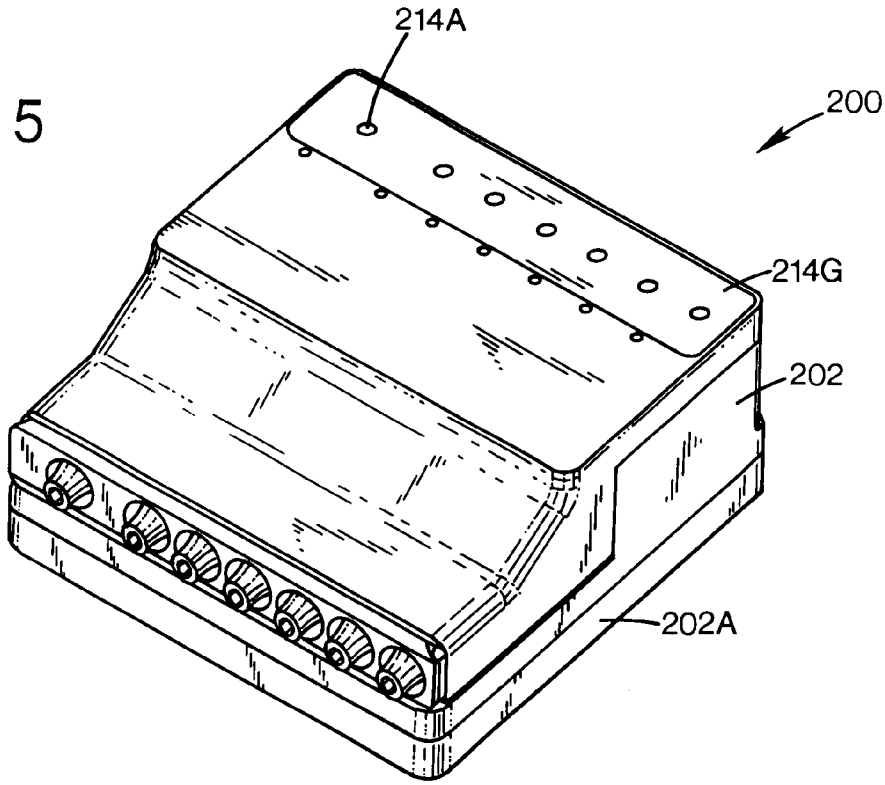
FIG. 5 is a top isometric view of an embodiment of a multi-color PHA system comprising a plurality of the PHA units illustrated in FIG. 1.
Figure 6:
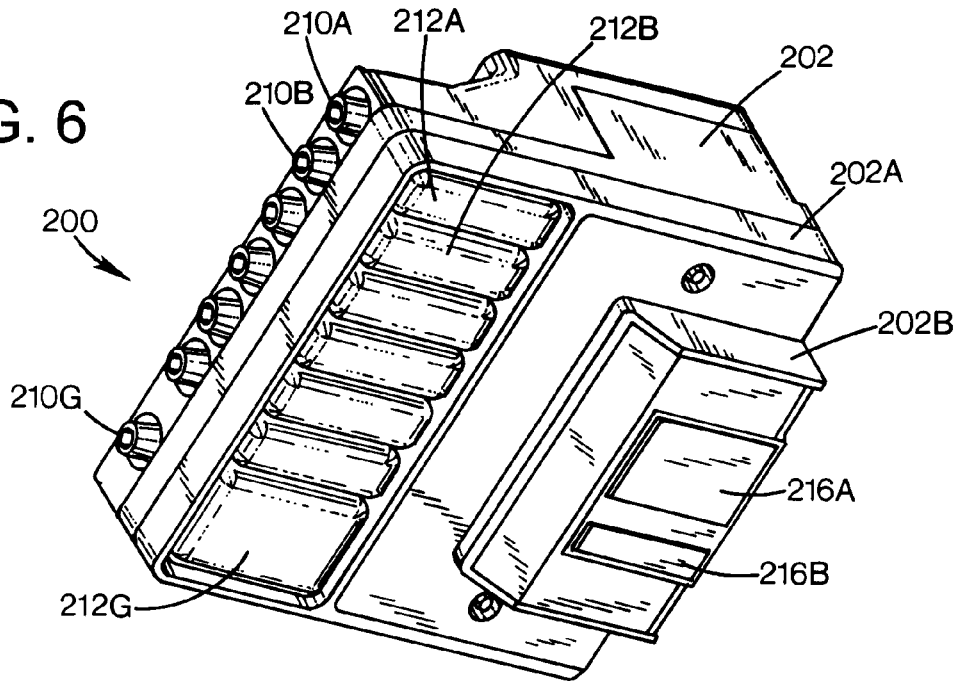
FIG. 6 is a bottom isometric view of the multi-color PHA system of FIG. 5.

In an exemplary embodiment, the PHA 50 can be replicated to provide a unit with many color chambers having fluid connection to a single large print head or a set of multiple print heads, each plumbed with a multitude of fluid colors. This function can be accomplished while the PHA remains relatively compact. For example, FIGS. 5–6 illustrate a highly compact multicolor (seven in this embodiment) print head assembly 200, incorporating over-molded gland seal geometry that allows for very dense packing of the fluid channels, allowing many colors to be routed to a single print head assembly. The PHA system 200 is configured for seven colors, although fewer or greater numbers of colors can be employed. Thus, the PHA system 200 includes seven of the PHA units 50 as shown in FIG. 1. The system 200 includes a housing structure 202, which can be fabricated of injection molded plastic such as liquid crystal polymer (LCP), polyphenyleynesulfilde (PPS), PET or ABS. The system includes a plurality of fluid interconnects 210A–210G, each similar to interconnect 52 of the unit 50, and diaphragm pumps 212G (FIG. 6) each corresponding to pump 64 of unit 50. The pumps need not be of the same capacity, and this is illustrated in FIG. 6, wherein pump 212G is illustrated with a larger size than the other pumps. This can be useful, e.g. for a fluid color, typically black, that receives heavier usage than other colors. Each PHA unit of system 200 also has a vent 214A–214G, each of which corresponds to vent 84 of unit 50. The system 200 includes two printhead portions 216A, 216B. In this example, the printhead portion 216A is a nozzle plate having six different nozzle arrays, each for a different color, and printhead portion 216B is a nozzle plate having a nozzle array or multiple arrays for black fluid.

The housing structure 202 defines cavities for the common chambers, the capillary chambers, the plenums and the fluid flow channels needed for each unit as described with respect to the unit 50 of FIG. 1.

The PHA system 200 thus includes independent fluid systems for each color, that are ganged for size efficiency. It incorporates ganged fluid interconnects, pumps, chambers, and fluid channels. This degree of ganging allows for a ratio of colors per volume that is less than any known IDS.

This exemplary embodiment of a TAS system is off axis, and requires no tubes. Therefore, no swept volume or routing volume is required to accommodate a tubing component. The TAS nature of the design eliminates the size inefficiency of previous off-axis inkjet designs.

Free fluid supplies are inherently volumetric efficient because no volume is occupied by back pressure mechanisms such as capillary materials like foam. This system eliminates most of the common requirements of the fluid supply, so that the simplified result is basically a box or bag of free fluid.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A fluid delivery system, comprising:

a print head assembly (PHA) including a PHA body structure for mounting in a movable carriage of a printing system;

an air-fluid separator structure;

an air vent region in communication with the separator structure;

a printhead;

a fluid plenum in fluid communication with the printhead and the air-fluid separator structure;

a PHA free fluid reservoir;

a fluid re-circulation path disposed within said PHA body structure and passing through said separator structure, said plenum and said free fluid reservoir;

a pump structure supported by said PHA body structure for re-circulating fluid through said re-circulation path during a pump mode;

a PHA fluid interconnect; and a fluid supply for mounting off the carriage and including a supply reservoir for holding a supply of free fluid and a supply fluid interconnect adapted to connect to said PHA fluid interconnect during a replenishment mode to provide a fluid connection between the supply reservoir and the PHA fluid reservoir when a pressure differential between the PHA and the supply reservoir is sufficient to draw fluid through the fluid interconnect to replenish the fluid in the PHA fluid reservoir.

2. The system of claim 1, wherein said fluid re-circulation path has disposed therein at least one fluid control valve structure permitting fluid flow only in a re-circulation direction.

3. The system of claim 2, wherein the at least one fluid control valve structure comprises a first one-way fluid valve structure disposed in the fluid re-circulation path between the PHA free fluid container and said air-fluid separator, and a second one-way fluid valve structure disposed in the fluid re-circulation path between the fluid plenum and the PHA free fluid reservoir.

4. The system of claim 3 wherein said first one-way fluid valve structure comprises a first check valve, and the second one-way fluid valve structure comprises a second check valve, each of said first and second check valves having a corresponding break pressure to be exceeded before allowing fluid flow in said re-circulation direction.

5. The system of claim 1 further comprising a pump actuator for actuating said pump structure.

6. The system of claim 1 wherein the pump actuator is positioned at a service location.

7. The system of claim 1, wherein the air-fluid separator structure includes a body of capillary material.

8. The system of claim 7, wherein the capillary material creates a capillary force to provide a negative pressure head at the fluid plenum, and wherein the negative pressure head under a condition of capillary fluid depletion is sufficient to draw fluid through the fluid interconnect from said supply reservoir to said PHA free fluid reservoir.

9. The system of claim 7, wherein the capillary material creates a capillary force to provide a dynamic negative pressure head at the fluid plenum, and wherein the negative pressure head under a condition of capillary fluid depletion is greater than the dynamic pressure head under a condition of capillary fluid saturation.

10. The system of claim 1, wherein the fluid supply further includes a normally closed fluid valve which opens in response to said pressure differential.

11. The system of claim 1, wherein the PHA further includes a normally closed fluid valve in fluid communication with the PHA fluid interconnect which opens in response to said pressure differential.

12. The system of claim 1, wherein the fluid supply includes a snorkel fluid path running between the supply fluid interconnect and a bottom wall of the ink supply through which replenishment fluid flow from the supply reservoir to the supply fluid interconnect.

13. A printer, comprising:

a movable carriage;

a print head assembly (PHA) including a PHA body structure mounted in the movable carriage;

an air-fluid separator structure;

an air vent region in communication with the separator structure;

a printhead for ejecting droplets of fluid;

a fluid plenum in fluid communication with the printhead and the air-fluid separator structure;

a PHA free fluid reservoir;

a fluid re-circulation path disposed within said PHA body structure and passing through said separator structure, said plenum and said free fluid reservoir;

a pump structure supported by said PHA body structure for re-circulating fluid through said re-circulation path during a pump mode;

a PHA fluid interconnect; and an fluid supply mounted off the carriage and including a supply reservoir for holding a supply of free fluid and a supply fluid interconnect adapted to connect to said PHA fluid interconnect during a replenishment mode to provide a fluid connection between the supply reservoir and the PHA fluid reservoir when a pressure differential between the PHA and the supply reservoir is sufficient to draw fluid through the fluid interconnect to replenish the fluid in the PHA fluid reservoir.

14. The printer of claim 13, further comprising:

an actuator mounted off the carriage for actuating the pump structure during the replenishment mode.

15. The printer of claim 13, further including means for bringing the PHA and fluid supply together to establish the fluid connection during the replenishment mode.

16. A fluid delivery system, comprising:

a print head assembly (PHA) including a PHA body structure;

an air-fluid separator structure within the PHA body structure;

an air vent region in communication with the separator structure;

a printhead mounted to the PHA body structure;

a fluid plenum within the PHA body structure in fluid communication with the printhead and the air-fluid separator structure;

a PHA free fluid reservoir in the PHA body structure;

a fluid re-circulation path disposed within said PHA body structure and passing through said separator structure, said plenum and said free fluid reservoir;

a pump structure supported by said PHA body structure for re-circulating fluid through said re-circulation path; and an fluid supply for mounting off the carriage and including a supply reservoir for holding a supply of fluid adapted to intermittently connect to said PHA through a fluid connection during a replenishment mode while the pump structure is actuated to draw fluid through the fluid connection to replenish the fluid in the PHA fluid reservoir only when a pressure differential between the PHA and the supply reservoir is sufficient to draw fluid through the fluid connection.

17. The system of claim 16, wherein said fluid re-circulation path has disposed therein at least one fluid control valve structure permitting fluid flow only in a re-circulation direction.

18. The system of claim 17, wherein the at least one fluid control valve structure comprises a first one-way fluid valve structure disposed in the fluid re-circulation path between the PHA free fluid container and said air-fluid separator, and a second one-way fluid valve structure disposed in the fluid re-circulation path between the fluid plenum and the PHA free fluid reservoir.

19. The system of claim 16, wherein the air-ink separator structure includes a body of capillary material developing a dynamic negative pressure at the plenum.

20. The system of claim 16 further comprising a pump actuator for actuating said pump structure.

21. The system of claim 20 wherein the pump actuator is positioned at a service location.

22. The system of claim 16, wherein the fluid supply further includes a normally closed fluid valve which opens in response to said pressure differential.

23. The system of claim 16, wherein the PHA further includes a normally closed fluid valve which opens in response to said pressure differential.

24. A method for supplying fluid to a print head assembly (PHA), comprising:

mounting the PHA on a movable carriage of a printing system;

positioning an fluid supply at a supply location off the carriage including a supply reservoir holding a supply quantity of free fluid;

bringing the print cartridge and fluid supply into mating contact so that a PHA fluid interconnect is engaged with a supply fluid interconnect to provide a fluid interconnect path;

pumping fluid through a closed re-circulation path within a PHA housing structure to pump fluid from a PHA free fluid chamber to a PHA capillary structure to a PHA fluid plenum in fluid communication with a PHA printhead and to the free fluid chamber;

with the capillary structure in a fluid-depleted state, using a dynamic pressure differential between said fluid plenum and said free fluid chamber to draw fluid from the fluid supply reservoir through the fluid interconnect path until the capillary structure reaches a less depleted state.

25. The method of claim 24, wherein said dynamic pressure differential opens a normally-closed, one way fluid flow valve in said fluid interconnect path.

26. The method of claim 24, further comprising:

separating air bubbles from the liquid fluid at a surface of the capillary structure; and venting the air bubbles through an air vent in the housing structure.

27. The method of claim 24, wherein the step of pumping includes:

activating a pump through a plurality of pump cycles to incrementally pass fluid through the fluid re-circulation path into the capillary structure, and wherein the dynamic pressure differential decreases with each pump cycle, until a pressure balance is reached and fluid is not drawn through the fluid interconnect path from the fluid supply for successive pump cycles.

28. A method for supplying fluid to a print head assembly (PHA) comprising:

mounting a PHA including a PHA housing structure, a capillary structure for holding a supply of fluid under negative pressure, a free fluid chamber, a printhead and a fluid plenum in fluid communication between the capillary structure and the printhead on a movable carriage of a printing system;

positioning an fluid supply at a supply location off the carriage including a supply reservoir holding a supply quantity of free fluid;

bringing the print cartridge and fluid supply into mating contact so that a PHA fluid interconnect is engaged with a supply fluid interconnect to provide a fluid interconnect path;

pumping fluid through a closed re-circulation path within the PHA housing structure to pump fluid from the free fluid chamber to the capillary structure to the plenum and to the free fluid chamber;

with the capillary structure in a fluid-depleted state, using a dynamic pressure differential between said fluid plenum and said free fluid chamber to draw fluid from the fluid supply reservoir through the fluid interconnect path until the capillary structure reaches a less depleted state.

29. The method of claim 28, wherein said dynamic pressure differential opens a normally-closed, one way fluid flow valve in said fluid interconnect path.

30. The method of claim 28, further comprising:

separating air bubbles from the liquid fluid at a surface of the capillary structure; and venting the air bubbles through an air vent in the housing structure.

31. The method of claim 28, wherein the step of pumping includes:

activating a pump through a plurality of pump cycles to incrementally pass fluid through the fluid re-circulation path into the capillary structure, and wherein the dynamic pressure differential decreases with each pump cycle, until a pressure balance is reached and fluid is not drawn through the fluid interconnect path from the fluid supply for successive pump cycles.

32. A fluid delivery system, comprising:

a multicolor print head assembly (PHA) including a PHA body structure for mounting in a movable carriage of a printing system;

a plurality of PHA units, each assembled in said PHA body structure, each PHA unit comprising:

an air-fluid separator structure;

an air vent region in communication with the separator structure;

a printhead;

a fluid plenum in fluid communication with the printhead and the air-fluid separator structure;

a PHA free fluid reservoir;

a fluid re-circulation path disposed within said PHA body structure and passing through said separator structure, said plenum and said free fluid reservoir;

a pump structure supported by said PHA body structure for re-circulating fluid through said re-circulation path during a pump mode;

a PHA fluid interconnect; and an fluid supply for mounting off the carriage and including for each PHA unit a supply reservoir for holding a supply of free fluid and a supply fluid interconnect adapted to connect to said PHA fluid interconnect during a replenishment mode to provide a fluid connection between the supply reservoir and the PHA fluid reservoir when a pressure differential between the PHA and the supply reservoir is sufficient to draw fluid through the fluid interconnect to replenish the fluid in the PHA fluid reservoir.

* * * * *